United States Patent [19]

Peil et al.

[11] Patent Number: 4,558,842

[45] Date of Patent: Dec. 17, 1985

[54] CONNECTOR FOR JOINING BLOWOUT PREVENTER MEMBERS

[75] Inventors: Archie W. Peil; Arnal B. Foreman, Jr., both of Houston, Tex.

[73] Assignee: Bowen Tools, Inc., Houston, Tex.

[21] Appl. No.: 719,044

[22] Filed: Apr. 4, 1985

Related U.S. Application Data

[63] Continuation of Ser. No. 529,383, Sep. 6, 1983, abandoned.

[51] Int. Cl.[4] ..... E21B 33/06

[52] U.S. Cl. ..... 251/1.3; 403/155; 403/375; 403/377; 285/91; 285/305

[58] Field of Search ..... 251/1 R, 1 B, 1 A; 92/161, 146; 403/155, 324, 375, 377; 285/91, 305

[56] References Cited

U.S. PATENT DOCUMENTS

| | | | |
|---|---|---|---|
| 2,942,616 | 6/1960 | Wilde | 92/161 |
| 3,128,116 | 4/1964 | Patriquin et al. | 285/305 |
| 3,560,027 | 2/1971 | Graham | 285/305 |
| 3,692,316 | 9/1972 | Bishop et al. | 277/73 |
| 4,109,672 | 8/1978 | Szemeredi | 137/454.2 X |
| 4,269,075 | 5/1981 | Crist et al. | 285/305 |
| 4,289,335 | 9/1981 | Olbermann | 285/91 |
| 4,416,441 | 11/1983 | Van Winkle | 251/1 A |
| 4,423,892 | 1/1984 | Bartholomew | 285/305 |
| 4,433,861 | 2/1984 | Kreczik | 285/305 |

*Primary Examiner*—Robert E. Garrett
*Assistant Examiner*—Richard S. Meyer
*Attorney, Agent, or Firm*—Pravel, Gambrell, Hewitt & Kimball

[57] ABSTRACT

A blow-out preventer for attachment with a tubular member of a well for containing well pressures within the well as needed, having a body adapted to receive a ram body mounted therein for movement between an open and closed position. The preventer further includes an actuator body member mounted with the body adjacent the ram bore and having urging means therewith for urging the ram body between such open and closed positions and alignment means with the actuator body member and the ram body for ensuring proper alignment and positioning of the ram body with respect to the ram bore and the axial bore of the tubular member. The actuator body member has fastening means that fits into connecting means in the preventer body. The two bodies are secured by securing means installed in said connection means and engaging said fastening means.

6 Claims, 3 Drawing Figures

CONNECTOR FOR JOINING BLOWOUT PREVENTER MEMBERS

This is a continuation of co-pending application Ser. No. 529,383, filed on Sept. 6, 1983, now abandoned.

TECHNICAL FIELD

The field of this invention relates to devices commonly known as blow-out preventers which are commonly attached to a tubular member of a well for containing well pressures within the well, as necessary.

PRIOR ART

In drilling and producing oil or gas wells, it is necessary to use drill pipe to conduct drilling fluid while drilling, and production tubing to conduct oil and gas to the surface during production thereof. In all cases, a safety device for sealing the pipe from the outside and preventing the well from blowing out is necessary. Typically, such devices maintain well pressures within the inside diameter of the tubing and can be controlled by various types of chokes, valves and the like. A device such as this is commonly referred to as a blow-out preventer. Such blow-out preventers are commonly used in all phases of oil well operations including drilling, producing, servicing with jointed pipe, continuous coil tubing, strand lines, electrical conductor lines, slick piano wirelines and various other types of tools. All of these various phases of oil well operations require a blow-out preventer for performing such operations safely.

Typically, during wireline operations, it is necessary to spool wireline into a well under pressure. Two blow-out preventers are occasionally installed with packing elements opposing each other. Grease is typically injected between the blow-out preventers at pressure equal to the well pressure causing a somewhat pressure-equalizing effect. As such, the wireline may be easily inserted into the well with proper weighting attached thereto. In such prior art devices, typically, it is necessary that two blow-out preventers be dedicated for use in such a grease-injection operation, particularly due to the fact that such prior art blow-out preventers used rams that are aligned within the blow-out preventer based upon keyways machined within the bore of the body of the blow-out preventer. As a result of such keyways, the seals necessary for maintaining a sealable relationship between the ram body and blow-out preventer body must accordingly be on the opposing surfaces, thus limiting the orientation of the ram body within the blow-out preventer body due to the machined keyway and sealing members on the opposing surface of the ram bore within the preventer body. As such, this requires the dedication of two blowout preventers to properly seal against a potential well blow-out during such a grease injection operation inasmuch as the positioning of the seal is defined because of the keyway/ram seal configuration.

Examples of prior art blow-out preventers include those manufactured by Bowen Tools, Inc. under U.S. Pat. Nos. 3,692,316 and 3,379,255.

Furthermore, threading, which was a problem for many prior art devices, has been overcome by the slip type connection of the present invention. Thus, problems found in prior art blow-out preventers wherein the actuator body was threaded into the blow-out preventer body such as: changing and aligning the keys in the ram with a key slot; and difficulties in installation of the ram in the field due to friction in the ram bore, which results typically in requiring forcing the ram in by hand while encountering difficulties in the alignment of the adapter cylinder simultaneous with proper thread engagement, have been eliminated by the blow-out preventer of the present invention. Some examples of prior art blow-out preventers featuring threaded connections are U.S. Pat. Nos. 3,692,316; 3,379,255 and 3,272,222 (which features a bolted connection between the body and the actuating body member). U.S. Pat. No. 3,683,954, features a threaded connection between an actuating body member and a body in a double action fluid valve.

SUMMARY OF THE INVENTION

The present invention relates to a new and improved blow-out preventer connection between a preventer body and an actuating body member for attachment with a tubular member for containing well pressures within a well. The preventer includes a body adapted to be mounted with the tubular member with its axial bore in alignment therewith. The body has a ram bore substantially perpendicular to the axial bore, the body also featuring connecting means in a plane perpendicular to the ram bore. A ram body is adapted to be mounted within the ram bore of the body for movement between an open and closed position. An actuator body member is mounted with the body adjacent the ram bore featuring fastening means adapted to be located in said connecting means of said preventer body when said actuator body is mounted into the ram bore of the preventer body. The actuator body member further includes urging means with the actuator body for urging the ram body between the open and closed positions, and alignment means with the actuator body member and the ram body for ensuring proper alignment and positioning of the ram body with respect to the ram bore. Securing means are mounted in the connecting means of the preventer body and engage the fastening means on the actuator body member thereby holding and aligning the actuator body member within the body of the preventer.

DESCRIPTION OF THE PREFERRED EMBODIMENT

Figure 1:
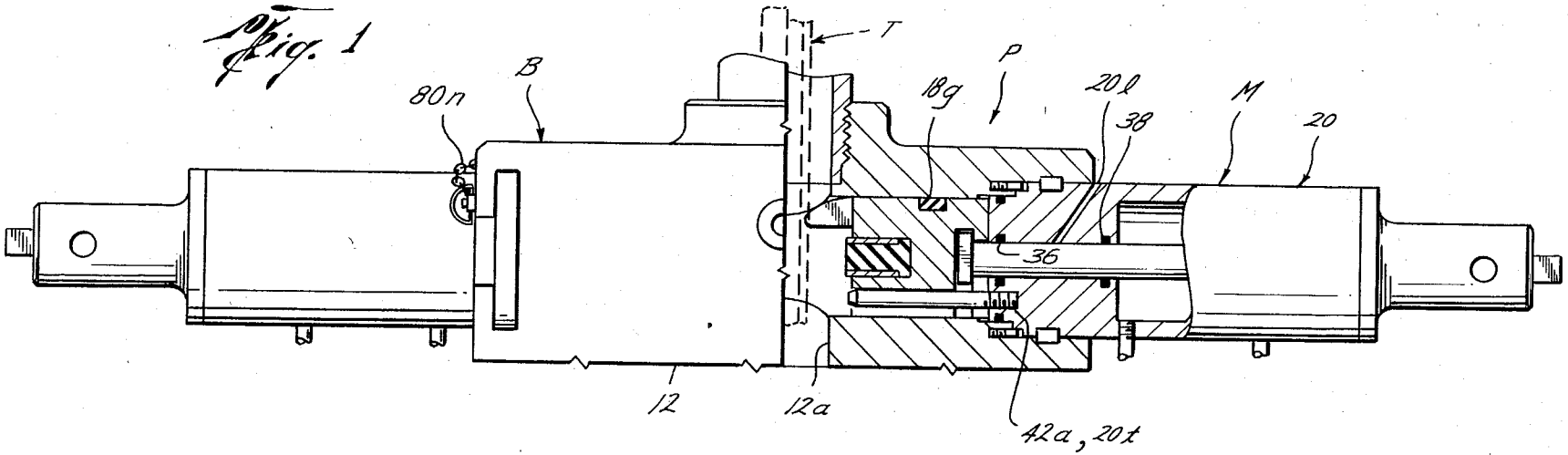
FIG. 1 depicts a part sectional part outline view of the blow-out preventer of the present invention.

In the drawings, the letter P designates generally the blow-out preventer of the present invention which is adapted for attachment with a tubular member T of a well (not shown) for containing well pressures within the well as needed. Generally speaking, the blow-out preventer P includes the body B adapted to be mounted with the tubular member T, a ram body R mounted with the body B, an actuator body member M mounted with body B, urging means U with the actuator body member M and alignment means A with the actuator body M and body B. Unless otherwise specified, it is preferred that the component parts of the blow-out preventer P of the present invention be made of a suitable high strength material, such as suitable steel and the like, capable of withstanding the pressures and temperatures typically encountered with the blow-out preventer P of the present invention.

The blow-out preventer P includes a body B that is adapted to be mounted with the tubular member T. The body B includes body housing 12 having an axial bore 12*a* formed therein which is adapted to be positioned in substantial axial alignment with the tubular member T. Furthermore, the body housing 12 includes a ram bore 12*b* formed therein with the ram bore 12*b* being substantially perpendicular to and intersecting the longitudinal axis of the axial bore 12*a*.

Undercut sealing surface 121, which is formed adjacent to ram bore 12*b*, is an annular surface slightly larger in diameter than ram bore 12*b* and adapted to accommodate annular surface 20*d*, including suitable seal 50 of actuator body 20 as set forth in more detail below. Radial surface 12*f* adjoins undercut sealing surface 121 and is in contact with body engaging surface 20*c* of actuator body 20 when said actuator body 20 is inserted into body housing 12. Annular surface 12*g* adjacent to radial surface 12*f* is of a diameter slightly larger than undercut sealing surface 121 thereby allowing space for mounting alignment pins 12*h* into surface 12*f*. Mounting pins 12*h* are threaded into body housing 12. The central axis of alignment pins 12*h* is parallel to the central axis of ram bore 12*b*. Alignment pins 12*h* engage alignment openings 20*z* in actuator body 20. Slot 12*j* protrudes through body housing 12 adjacent to annular surface 12*g*. Narrow segment 12*k* of slot 12*j* is located in a plane parallel to slot 12*j* between slot 12*j* and end surface 12*e*. End surface 12*e* is formed substantially perpendicular to the ram bore 12*b* adjacent to the outermost extremity of the ram bore 12*b*. First locking bores 12*m* extend from end surface 12*e* to slot 12*j* in an axis parallel to ram bore 12*b* and radially disposed around ram bore 12*b*.

The blow-out preventer P of the present invention further includes a ram body R which is adapted to be mounted within the ram bore 12*b* of the body housing 12 for movement between an open position as shown in FIG. 1 and a closed position (not shown). The ram body R includes a ram 18 which is adapted to be disposed within the ram bore 12*b*. The ram 18 is formed having a suitable engaging surface 18*a*, and a suitable detent 18*b* formed adjacent thereto for receiving ram inner seal 18*c*. The ram body R is formed having a guide rod opening 18*d* therein, with the guide rod opening 18*d* adapted to be in substantially parallel alignment with the longitudinal axis of the ram 18, which in turn is in longitudinal alignment with the ram bore 12*b*. The ram 18 is further formed having outer annular surface 18*e* which is formed having a suitable recess 18*f* adapted to receive an appropriate ram outer seal 18*g*. The ram outer seal 18*g* is adapted to suitably engage the ram bore 12*b* of body housing 12 of the body B as discussed more fully below. Adjacent end surface 18*h* of the ram 18, a suitable opening 18*i* is formed which is adapted to be in substantial axial alignment with the ram 18 and ram bore 12*b*, with a suitable stem detent 18*j* formed adjacent thereto. Stem slot 18*k* is formed adjacent to the stem detent 18*j*.

The blow-out preventer P of the present invention further includes an actuator body member M mounted with the body B adjacent the ram bore 12*b* of the body housing 12. The actuator body member M includes an actuator body designated generally as 20. The actuator body 20 is formed having an outer annular surface 20*a*, circumferential groove 20*b*, a body engaging surface 20*c* and an annular surface 20*f* is formed adjacent to end 20*g* with threaded portion 20*h* formed adjacent thereto. Piston cavity 20*j* is formed inside actuator body member M. An opening 201 is formed in the actuator body 20 between the outer annular surface 20*a* adjacent the piston cavity 20*j* and the end portion 20*e*. A suitable passageway 20*n* is formed in the actuator body such that it extends from opening 20*v* to a central portion of the opening 201. Furthermore, fluid ports 20*q* and 20*r* are formed to extend between the outer annular surface 20*a* and the piston cavity 20*j*. The actuator body 20 also includes a threaded guide rod opening 20*t* formed adjacent to and substantially perpendicular with end portion 20*e*.

The blow-out preventer P of the present invention further includes securing means S which consists of a plurality of flat plates 80 which are slidably mounted into slot 12*j* of body housing 12. The plates 80 have a leading end 80*b* which features an arcuate surface 80*a*. When the plates 80 are installed into slot 12*j*, the leading arcuate surface 80*a* is adapted to fit into circumferential groove 20*b* of actuator body 20 while leading end 80*b* on each flat plate is in contact with the corresponding leading end 80*b* on another plate. Flat plate 80 also contains a travel stop 80*h* which has an engaging arcuate surface 80*d*. Travel stop 80*h* is mounted on top surface 80*i* of flat plate 80 with engaging arcuate surface 80*d* set back from leading arcuate surface 80*a* of flat plate 80. Travel stop 80*h* is disposed to slide in narrow segment 12*k* adjacent to slot 12*j*. Therefore, the blow-out preventer P of the present invention is assembled by placing actuator body 20 in alignment with the ram bore 12*b* of body housing 12 until circumferential groove 20*b* is in the same plane as slot 12*j*. At that point, flat plates 80 are inserted into slot 12*j* until leading ends 80*b* of the flat plates 80 come into contact. At that time, arcuate surface 80*a* will be in contact with inner surface 20*a* of circumferential groove 20*b* of actuator body member 20. At the same time, the engaging arcuate surface 80*d* of travel stop 80*h* will contact the outer annular surface 20*a* of the actuator body member 20. Having fully inserted plates 80 into slot 12*j*, first locking bores 12*m* will be in substantial alignment with second locking bores 80*e* located on flat plate 80. At that point, securing pins 80*g* may be installed into first locking bore 12*m* and second locking bore 80*e* thereby ensuring proper orientation of ram actuator body member 20 to body housing 12. Securing chain 80*n* prevents loss of securing pins 80*g* by loosely connecting securing pins 80*g* to body housing 12. Flat plates 80 also contain an oblong opening 80*f* which facilitates installation and removal of plates 80*f* into slot 12*j*. As can readily be seen, flat plates 80 may be installed and removed from slot 12*j* without the use of hand tools.

Figure 2:
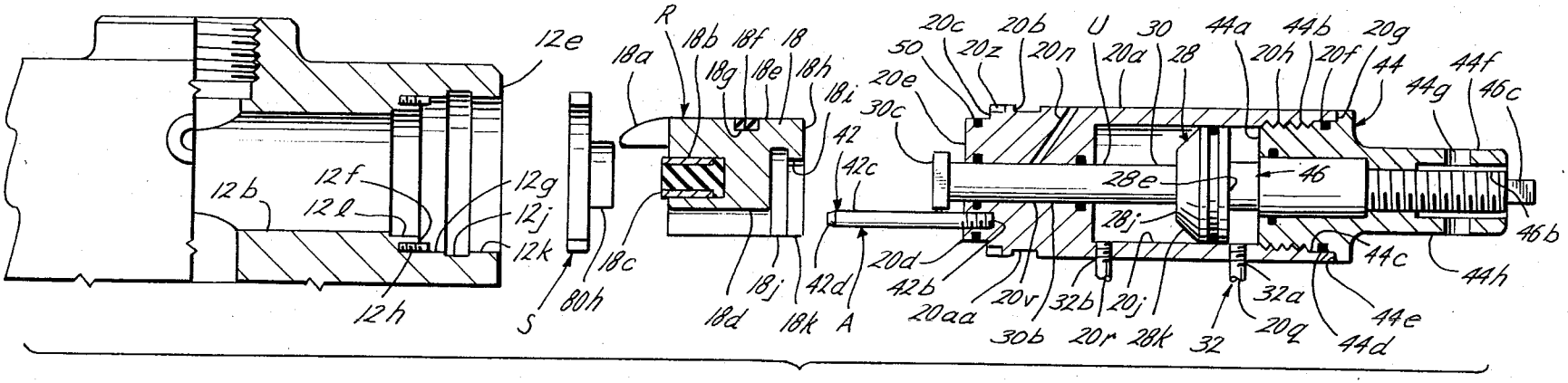
FIG. 2 is an exploded, sectional view of a portion of the blow-out preventer of the present invention, as shown in FIG. 1.
Figure 3:
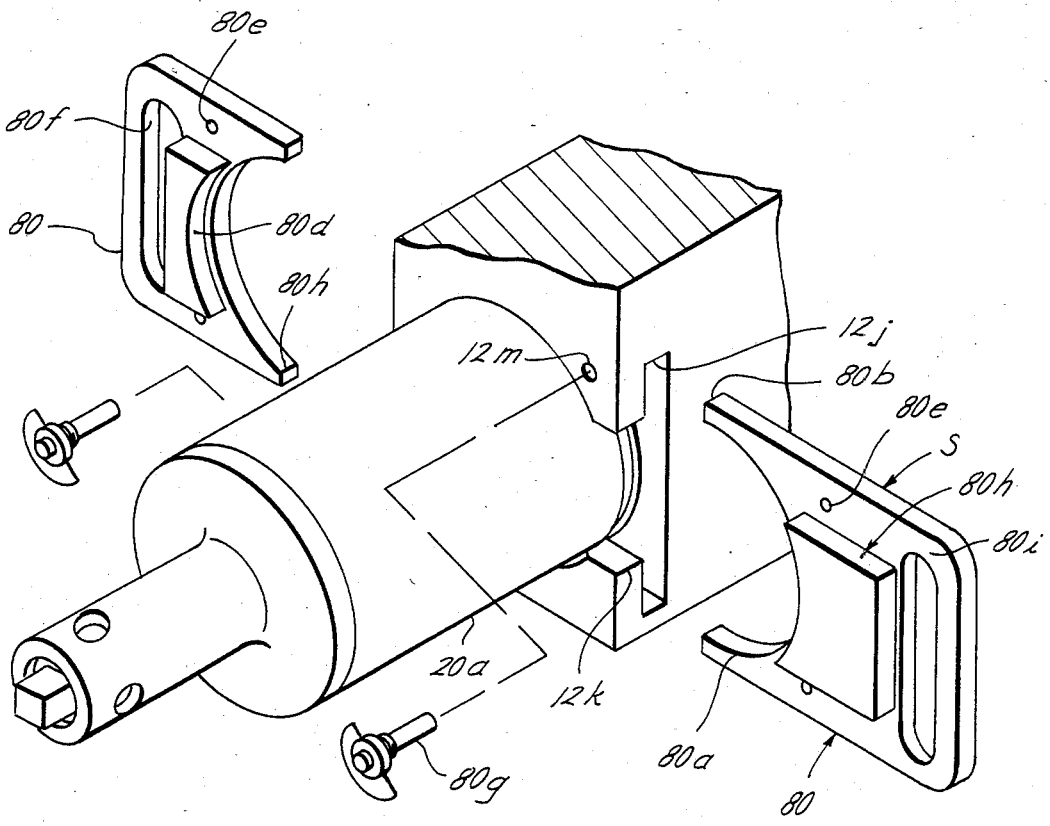
FIG. 3 is an exploded axonometric projection of a blow-out preventer of the present invention, showing the connection between the preventer body and the actuator body member.

The blow-out preventer P of the present invention further includes urging means U with the actuator body member M for urging the ram body R between the open position of FIGS. 1 and 2 and a closed position (not shown). The urging means U of the present invention includes a piston 28, piston stem 30 and fluid pressure means 32. As noted hereinabove, the actuator body 20 includes a piston cavity 20*j* which is adapted to receive the piston 28 therein. It should be noted that piston cavity 20 is in fluid communication with the fluid pressure means 32 by means of fluid lines 32*a*, 32*b* respectively, which are threadedly received in fluid ports 20*q*, 20*r* formed in actuator body 20. As such, a suitable fluid, such as hydraulic fluid, may flow through the fluid lines 32*a*, 32*b* of the fluid pressure means 32 thereinto the piston cavity 20*j*, as is necessary for proper operation of the blow-out preventer P of the present invention.

The urging means U further includes piston stem 30 which is of a preferably cylindrical elongate configuration and further including a stem head 30*c* formed adjacent thereto which also is preferably of a circular configuration. The piston stem 30 is adapted to be mounted with the ram body R in such a fashion that the stem head 30*c* of the piston stem 30 is received within the stem detent 18*j* of the ram 18, with the central stem 30*b* adapted to extend therefrom and through the opening 18*i*, opening 20*v* formed in the actuator body 20 thereinto the piston cavity 20*j*, into piston 28. It should be noted that suitable seals 36 and 38 ensure a fluid tight relation between the piston stem 30 and actuator body 20 and piston 28, respectively.

The blow-out preventer P of the present invention further includes alignment means A with the actuator body member M and the ram body R for ensuring proper alignment and positioning of the ram body R with respect to the ram bore 12*b* of the body housing 12 and the axial bore 12*a*. The alignment means A includes a ram guide rod 42 which cooperates with and between the ram body R and the actuator body member M. The ram guide rod 42 includes a threaded shank 42*a* adjacent end 42*b*, and a central elongate rod 42*c* which terminates in a truncated conical end 42*d*. The ram guide rod 42 is adapted to be threadedly received within threaded opening 20*t* formed in the actuator body 20 and extend therefrom and therethrough a suitably formed guide rod opening 18*d* formed in the ram 18. It will be appreciated that the ram guide rod 42 prevents the stem head 30*c* of the piston stem 30 from moving out of its suitable stem detent 18*j* and stem slot 18*k*. Preferably, stem slot 18*k* is preferably of a width corresponding substantially with that of the diameter of the central stem 30*b* of piston stem 30.

Proper positioning of the alignment means A, more specifically the ram guide rod 42, results in the ram guide rod 42 being substantially parallel with the ram bore 12*b* as is the guide rod opening 18*d* in the ram body R. Furthermore, as such, the ram guide rod 42 is mounted with the actuator body member M and extends through at least a portion of the guide rod opening 18*d* in the ram 18 of the ram body R during movement of the ram body R between an open position of FIGS. 1 and 2 and a closed position (not shown) and discussed more fully hereinbelow.

The blow-out preventer P of the present invention further includes an end cap 44 (FIG. 2) which is adapted to receive therein piston lock 46. The end cap 44 is formed having an end portion 44*a*, threads 44*b* formed adjacent thereto, with a sealing surface 44*c* having suitable seal 44*d* therewith and a radial surface 44*e* adjacent thereto. The end cap 44 further includes a neck portion 44*h* having a suitable opening 44*g* formed therein adjacent to end 44*f*. The piston lock 46 is adapted to be received within end cap 44 from substantially from a point adjacent the end portion 44*a* of the end cap 44 to a point adjacent the end 44*f* of the end cap 44. A handle tab 46*c* is formed with the threaded shaft 46*b*.

In the use or operation of blow-out preventer P of the present invention, the ram body R is movable between the open position of FIGS. 1 and 2 and a closed position. In order to move the ram body R to the closed position, it is necessary for the following steps to be followed. As best seen in FIG. 2, the ram body R is in a fully opened and locked position. In order to effectuate movement to a closed position, first the piston 28 must be unlocked. To effectuate the unlocking of the piston 28, it is necessary that the handle tab 46*c* be rotated which results in the consequent unlocking of the piston. This movement results in the ram body R moving to the left as viewed in FIGS. 1 and 2.

Once unthreaded and released, the piston 28 is free to move within piston cavity 20*j* upon actuation of the fluid pressure means 32. If it is desired to close the blow-out preventer P of the present invention, the fluid pressure means 32 is actuated and fluid flows through flow line 32*a* into piston cavity 20*j* to react against end surface 28*e* of the piston 28 to result in movement of the piston to the left as viewed in FIG. 2. Such movement reacts upon the piston stem 30 which in turn reacts upon ram 18, with the ram 18 thereafter moving to the left.

As shown generally in FIG. 1, it should be noted that the blow-out preventer P of the present invention contemplates utilization of horizontally opposed rams 18 which result in simultaneous action of two rams 18 moving toward the center portion of the axial bore 12*a* of the body housing 12. As such, in response to fluid pressure acting upon the piston 28, the ram 18 moves towards the center portion of the axial bore 12*a* for suitable sealing therein as is needed. During the operation of the blow-out preventer P of the present invention, the alignment means A ensures that the ram 18 remains properly aligned within the ram bore 12*b* to ensure proper orientation of the ram seal 18*c*. Well pressures are further contained by means of the ram outer seal 18*g*. It will be appreciated that when the ram 18 is in its fully extended, closed position (not shown) that the ram guide rod 42 will still remain within a portion of the guide rod opening 18*d* of the ram 18. When it is desired that the blow-out preventer P be actuated in such a fashion that the ram is retracted from its closed position to the open position, fluid pressure is relieved through fluid flow line 32*a* and thereafter redirected into fluid flow line 32*b* so that the fluid pressure then may act upon end 28*j* and surface 28*k* of the piston 28. Such action on the piston 28 results in a retraction of the piston stem 30, having the ram 18 therewith as the piston moves within the piston cavity 20*j* of the actuator body towards the initial position in FIG. 2 whereinafter the ram 18, piston stem 30 and piston 28 may remain in an open position merely by maintaining fluid pressure through the fluid pressure means 32 acting through fluid line 32*b*. The ram body R may thereafter be locked in an open position by rotating handle tab 46*c* thereby securing piston stem 30 and upon completion thereof the fluid pressure means 32 may be removed therefrom.

In using the blow-out preventer P of the present invention, it should be noted that the entire ram body R, actuator body member M, end cap 44 may easily be removed from the body B by merely removing flat plates 80 from the body housing 12. Thereby permitting the actuator body member M including the piston 28, piston stem 30, alignment means A and ram body R along with the end cap 44, piston lock 46 to be removed from the body B. As such, all components such as seals and the like may easily be replaced and reinstalled with minimum down time. The ram body may be inverted so that the ram outer seal 18g may be located at the lowermost portion of the ram bore 12b as best seen in FIGS. 1 and 2.

The blow-out preventer P of the present invention provides many advantages over prior art blow-out preventers in that many require machining of keyways within a ram bore in order to ensure longitudinal alignment of the ram within its corresponding bore. By use of the alignment means A of the present invention, there is no requirement that a keyway be machined into the bore. The ram is adapted to be positioned with the ram outer seal 18g in either an upper position within the ram bore 12b as shown in FIG. 2 or in a lower position (not shown) by mere proper orientation of the actuator body member M and body B. This capability of inverting the ram body R results in no requirement that the blow-out preventer body B be changed or themselves be disconnected and mounted in an inverted fashion. Furthermore, because of the ease in removal of the ram body R by means of the flat plates 80, the ram bore 12b may easily be reworked. Furthermore, because of this slip type connection, make-up of the actuator body member M with the body B by means of threading is no longer necessary as has been the case in many prior art blow-out preventers of the ram type. Thus, major difficulties including (1) changing and aligning the keys in the ram with a key slot of prior art blow-out preventers and (2) installation of the ram in the field due to friction in the ram bore which results typically in a requirement of forcing the ram in by hand while having difficulties in the alignment of the adapter cylinder simultaneously with proper thread engagement, have been eliminated by the blow-out preventer P of the present invention. Furthermore, by eliminating the key of prior art blow-out preventers, less machining is required on the body B during the manufacture thereof.

Because of the flexibility of the blow-out preventer P of the present invention, with its capability of permitting the ram outer seal 18g to be positioned in either an uppermost or lowermost position within the ram bore 12b, the blow-out preventer P of the present invention may also be used in a conventional blow-out preventer arrangement or in a grease injection mode thus, reducing the number of blow-out preventers that would be necessary for use with any particular type of well.

Although the foregoing disclosure has discussed a particular design for a blow-out preventer, such discussion is illustrative since the invention contemplates a novel connection between body parts for all types of blow-out preventers.

The foregoing disclosure and description of the invention are illustrative and explanatory thereof, the various changes in the size, shape and materials, as well as the details of the illustrated contruction may be made without departing from the spirit of this invention.

We claim:

1. A blowout preventer for attachment to a tubular member of a well for containing pressures within the well, comprising:

a body adapted to be mounted with the tubular member, said body formed having an axial bore therein and adapted to be positioned in substantial axial alignment with the tubular member of the well, said body having a ram bore therein, said ram bore substantially perpendicular to and intersecting the longitudinal axis of said axial bore, said body having a slot therethrough, said slot being in a plane substantially perpendicular to the axis of said ram bore;

a ram actuator body member releasably mounted with said body, said ram actuator body member having a circumferential groove extending around the entire circumference of said ram actuator body and adapted to be aligned with said slot for mounting and disconnecting said ram actuator body member from said body;

securing means including two plates each of which is of substantially the same width as said slot for slidable mounting in said slot and in said groove, and with both plates in the same plane, said plates having a leading arcuate end whose radius is at least equal to the radius of said circumferential groove measured at the longitudinal ram actuator body surface within said groove, to extend into and to engage said circumferential groove of said actuator body member substantially around its entire circumference to mount said ram actuator body member with said body; and said securing means also including securing members removably mounted with said body and said plates for releasably connecting said ram actuator body member with said body.

2. The apparatus of claim 1, wherein said slot comprises of a narrow segment, said narrow segment extending from said slot to the end of said ram bore on said body and in a plane substantially parallel to said slot.

3. The apparatus of claim 1, wherein:

each of said plates comprises a travel stop said travel stop having an engaging arcuate surface whereupon insertion of each of said plates into said slot said leading arcuate end of each of said plates engages said circumferential groove on said ram actuator body while simultaneously said travel stop abuts said ram actuator body member.

4. The apparatus of claim 3, wherein:

said body defines a plurality of first locking bores said first locking bores located in an axis parallel to said ram bore and radially disposed around said ram bore and extending from the face of said body where said ram actuator body member is mounted into said slot;

each of said plates comprise at least one second locking bore so disposed on each of said plates so that when each of said plates is fully inserted into said slot, said first locking bores are in alignment with said second locking bores; and a plurality of pins, said pins releasably mounted in said first and second locking bores when said first and second locking bores are in alignment thereby insuring proper orientation of said ram actuator body member to said body.

5. The device of claim 4, wherein each said plate defines an oblong opening, said opening designed to facilitate installation and removal of said plate without the use of hand tools.

6. The apparatus of claim 1 wherein said securing means further comprises:

a plurality of pins, said pins extending through said body, said plates, and said slot when said plates are substantially inserted into said slot thereby insuring proper orientation of said ram actuator body member to said body.

* * * * *